US011492707B2

(12) United States Patent
Dahlenburg et al.

(10) Patent No.: US 11,492,707 B2
(45) **Date of Patent: *Nov. 8, 2022**

(54) METHOD FOR SPECIFICALLY ADJUSTING THE ELECTRICAL CONDUCTIVITY OF CONVERSION COATINGS

(71) Applicant: Chemetall GmbH, Frankfurt (DE)

(72) Inventors: Olaf Dahlenburg, Neu-Isenburg (DE); Frank Hollmann, Leutkirch (DE); Michael Droege, Frankfurt am Main (DE); Thomas Kolberg, Heppenheim (DE); Lisa Schmeier, Freigericht-Bernbach (DE)

(73) Assignee: CHEMETALL GMBH, Frankfurt (DE)

( * ) Notice: Subject to any disclaimer, the term of this patent is extended or adjusted under 35 U.S.C. 154(b) by 288 days.

This patent is subject to a terminal disclaimer.

(21) Appl. No.: 15/562,653

(22) PCT Filed: Apr. 7, 2016

(86) PCT No.: PCT/EP2016/057620

§ 371 (c)(1),
(2) Date: Sep. 28, 2017

(87) PCT Pub. No.: WO2016/162422

PCT Pub. Date: Oct. 13, 2016

(65) Prior Publication Data

US 2018/0112314 A1 Apr. 26, 2018
US 2018/0334748 A9 Nov. 22, 2018

(30) Foreign Application Priority Data

Apr. 7, 2015 (DE) ..... 102015206145.0

(51) Int. Cl.
*C23C 22/82* (2006.01)
*C23C 22/48* (2006.01)
(Continued)

(52) U.S. Cl.
CPC ..... *C23C 22/83* (2013.01); *C23C 22/07* (2013.01); *C23C 22/182* (2013.01); *C23C 22/34* (2013.01);
(Continued)

(58) Field of Classification Search
CPC ..... C23C 22/82–83; C23C 2222/20
See application file for complete search history.

(56) References Cited

U.S. PATENT DOCUMENTS 3,819,423 A * 6/1974 Charles ..... C23C 22/83 148/256
6,447,662 B1 9/2002 Brouwer et al.
(Continued)

FOREIGN PATENT DOCUMENTS

DE 19511573 A1 10/1996
DE 19834796 A1 2/2000
(Continued)

OTHER PUBLICATIONS

International Search Report for International Application No. PCT/EP2016/057620, dated Jun. 20, 2016, 4 pages.
(Continued)

*Primary Examiner* — Lois L Zheng
(74) *Attorney, Agent, or Firm* — Armstrong Teasdale LLP

(57) ABSTRACT

Provided herein is a method for specifically adjusting the electrical conductivity of a conversion coating, wherein a metallic surface or a conversion-coated metallic surface is treated with an aqueous composition which comprises at least one kind of metal ions selected from the group consisting of the ions of molybdenum, copper, silver, gold, palladium, tin, and antimony and/or at least one electrically conductive polymer selected from the group consisting of the polymer classes of the polyamines, polyanilines, polyimines, polythiophenes, and polypyrrols.

8 Claims, 3 Drawing Sheets

(51) Int. Cl.

| | |
|---|---|
| ***C23C 22/83*** | (2006.01) |
| ***C23C 22/18*** | (2006.01) |
| ***C23C 22/36*** | (2006.01) |
| ***C25D 13/12*** | (2006.01) |
| ***C25D 13/20*** | (2006.01) |
| ***C23C 22/34*** | (2006.01) |
| ***C25D 5/48*** | (2006.01) |
| ***C23C 22/78*** | (2006.01) |
| ***C23C 22/07*** | (2006.01) |

(52) U.S. Cl.
CPC ..... *C23C 22/362* (2013.01); *C23C 22/364* (2013.01); *C23C 22/365* (2013.01); *C23C 22/78* (2013.01); *C23C 22/82* (2013.01); *C25D 5/48* (2013.01); *C25D 13/12* (2013.01); *C25D 13/20* (2013.01); *C23C 2222/20* (2013.01)

(56) References Cited

U.S. PATENT DOCUMENTS

2005/0176592 A1* 8/2005 Calvo ..... C09D 5/24 508/128
2007/0017602 A1* 1/2007 Koch ..... C23C 22/34 148/247
2007/0134503 A1* 6/2007 Espinosa ..... C09D 5/10 428/450
2008/0127859 A1* 6/2008 Kolberg ..... C23C 22/68 106/285
2008/0230395 A1* 9/2008 Inbe ..... C23C 22/34 205/261

FOREIGN PATENT DOCUMENTS

| | | | |
|---|---|---|---|
| EP | 0531575 | A1 | 3/1993 |
| WO | 9533083 | A1 | 12/1995 |
| WO | 0138605 | A2 | 5/2001 |
| WO | 03027203 | A2 | 4/2003 |
| WO | 2005061761 | A1 | 7/2005 |
| WO | 2014035691 | A1 | 3/2014 |
| WO | 2016/162423 | | 10/2016 |

OTHER PUBLICATIONS

International Search Report and Written Opinion for PCT Patent Application No. PCT/EP2016/057622, dated Jun. 30, 2016, 4 pages of English Translation and 10 pages of ISRWO.

* cited by examiner

METHOD FOR SPECIFICALLY ADJUSTING THE ELECTRICAL CONDUCTIVITY OF CONVERSION COATINGS

CROSS-REFERENCE TO RELATED APPLICATIONS

This application is the national stage entry of PCT/EP2016/057620 filed on Apr. 7, 2016, which claims the benefit of priority to German Patent Application No. 10 2015 206 145.0, filed on Apr. 7, 2015, which is incorporated by reference in its entirety herein.

FIELD OF THE INVENTION

The present invention relates to a method for specifically adjusting the electrical conductivity of a conversion coating on a metallic surface by means of an aqueous composition, and also to a corresponding aqueous composition and a corresponding conversion coating.

BACKGROUND

Conversion coatings on metallic surfaces are known from the prior art. Such coatings serve to protect the metallic surfaces from corrosion and also, moreover, as adhesion promoters for subsequent coating films.

The subsequent coating films are, in particular, cathodically deposited electrocoat materials (CEC). Since the deposition of CEC requires a flow of current between metallic surface and treatment bath, it is important to adjust the conversion coating to a defined electrical conductivity in order to ensure efficient and uniform deposition.

For this reason, conversion coatings are typically applied by means of a nickel-containing phosphating solution. The nickel ions incorporated into the conversion coating this way, and the nickel deposited in elemental form, provide a suitable conductivity on the part of the coating in the context of the subsequent electrocoating.

On account of their high toxicity and environmental harmfulness, however, nickel ions are no longer a desirable constituent of treatment solutions, and ought therefore as far as possible to be avoided or at least reduced in terms of their amount.

The use of nickel-free or low-nickel phosphating solutions is in fact known. Specifically adjusting the electrical conductivity of such phosphate coatings, however, continues to be associated with severe problems.

Other nickel-free or low-nickel systems represent thin-film coatings, which for instance are thin coatings of zirconium oxide and optionally at least one organosiloxane, and/or of at least one organic polymer.

Here as well, however, specifically adjusting the electrical conductivity for the purpose of subsequent electrocoating is still unsatisfactory. Accordingly, in many cases, more or less highly pronounced inhomogeneities in the deposited CEC cannot be avoided (known as mapping).

With the aforementioned low-nickel or nickel-free systems, moreover, unfavorable CEC deposition conditions may lead to poor corrosion figures and coating adhesion figures, owing to a lack of optimum adjustment of electrical conductivity in the conversion coating.

DESCRIPTION

Figure 1:
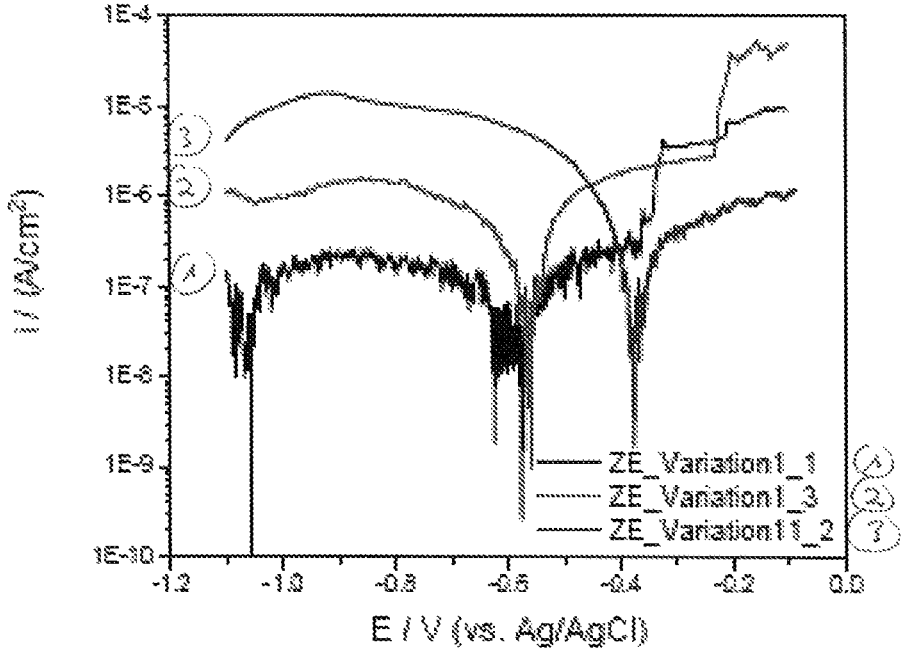
FIG. 1 depicts the current density over the voltage applied against a silver/silver chloride (Ag/AgCl) electrode for test plates according to Comparative Example 1 and Comparative Example 2 of the present disclosure.

It was an object of the present invention, therefore, to provide a method with which the electrical conductivity of a conversion coating on a metallic surface can be specifically adjusted, and with which, in particular, the disadvantages known from the prior art are avoided.

This object is achieved by a method, an aqueous composition, and a conversion coating according to the present disclosure.

In the method of the invention for specifically adjusting the electrical conductivity of a conversion coating, a metallic surface or a conversion-coated metallic surface is treated with an aqueous composition of the invention which comprises at least one kind of metal ions selected from the group consisting of the ions of molybdenum, copper, silver, gold, palladium, tin, and antimony and/or at least one electrically conductive polymer selected from the group consisting of the polymer classes of the polyamines, polyanilines, polyimines, polythiophenes, and polypryrols.

A "metal ion" here is alternatively a metal cation, a complex metal cation, or a complex metal anion.

By an "aqueous composition", is meant a composition which contains predominantly—that is, to an extent of more than 50 wt %—water as solvent. In addition to dissolved constituents, it may also comprise dispersed—that is, emulsified and/or suspended—constituents.

The method of the invention can be used to treat either an uncoated metallic surface or else a metallic surface which is already conversion-coated.

Another possibility is to first use the method of the invention to apply a conversion coating to an uncoated metallic surface, and then further to treat the thus conversion-coated metallic surface with the method of the invention.

Accordingly, the aqueous composition may on the one hand itself be a treatment solution for producing a conversion coating (one-pot process), or else may be used as an after-rinse solution for treating a conversion coating already produced.

It is possible, furthermore, first to use an aqueous composition of the invention as a treatment solution for producing a conversion coating, and then to use a second composition of the invention—whose constitution is the same or different—as an after-rinse solution for treating the conversion coating thus produced.

The metallic surface preferably comprises steel, a hot dip galvanized surface, an electrolytically galvanized surface, aluminum, or alloys thereof, such as Zn/Fe or Zn/Mg, for example.

According to one embodiment, the aqueous composition of the invention comprises at least one kind of metal ions selected from the group consisting of the ions of the following metals in the following preferred, more preferred, and very preferred concentration ranges (all calculated as the metal in question):

| | | | |
|---|---|---|---|
| Mo | 1 to 1000 mg/l | 10 to 500 mg/l | 20 to 225 mg/l |
| Cu | 1 to 1000 mg/l | 3 to 500 mg/l | 5 to 225 mg/l |
| Ag | 1 to 500 mg/l | 5 to 300 mg/l | 20 to 150 mg/l |
| Au | 1 to 500 mg/l | 10 to 300 mg/l | 20 to 200 mg/l |
| Pd | 1 to 200 mg/l | 5 to 100 mg/l | 5 to 100 mg/l |
| Sn | 1 to 500 mg/l | 2 to 200 mg/l | 3 to 100 mg/l |
| Sb | 1 to 500 mg/l | 2 to 200 mg/l | 3 to 100 mg/l |

The metal ions present in the aqueous composition deposit either in the form of a salt, which comprises the metal cation in question (e.g., molybdenum or tin) preferably in at least two oxidation states—more particularly in the form of an oxide hydroxide, a hydroxide, a spinel or a defect spinel—or in elemental form on the surface to be treated (e.g., copper, silver, gold or palladium).

The metal ions are preferably molybdenum ions. They are added preferably in the form of molybdate, more preferably ammonium heptamolybdate, and very preferably ammonium heptamolybdate×7 $H_2O$ to the aqueous composition.

Molybdenum ions, however, may also be added, for example, in the form of at least one salt containing molybdenum cations, such as molybdenum chloride, to the aqueous composition, and then oxidized to molybdate by a suitable oxidizing agent, as for example by the accelerators described later on below.

With further preference the aqueous composition comprises molybdenum ions in combination with copper ions, tin ions or zirconium ions.

With particular preference it comprises molybdenum ions in combination with zirconium ions and also, optionally, a polymer or copolymer, selected more particularly from the group consisting of the polymer classes of the polyamines, polyanilines, polyimines, polythiophenes, and polypryroles, and also mixtures and copolymers thereof, and polyacrylic acid, with the amount of molybdenum ions and zirconium ions in each case being in the range from 10 to 500 mg/l (calculated as metal).

The amount of molybdenum ions here is preferably in the range from 20 to 225 mg/l, more preferably from 50 to 225 mg/l, and very preferably from 100 to 225 mg/l, and the amount of zirconium ions is preferably in the range from 30 to 300 mg/l, more preferably from 50 to 200 mg/l.

According to another preferred embodiment, the metal ions are copper ions. The after-rinse solution then preferably contains these ions in a concentration of 5 to 225 mg/l, more preferably of 150 to 225 mg/l.

According to a further embodiment, the aqueous composition of the invention comprises at least one electrically conductive polymer selected from the group consisting of the polymer classes of the polyamines, polyanilines, polyimines, polythiophenes, and polypryrols. Preference is given to employing a polyamine and/or polyimine, more preferably a polyamine.

The polyamine is preferably a polyethyleneamine; the polyimine is preferably a polyethyleneimine.

The at least one electrically conductive polymer is present preferably in a concentration in the range from 0.1 to 5.0 g/l, more preferably from 0.2 to 3.0 g/l, and very preferably in the range from 0.5 to 1.5 g/l (calculated as pure polymer).

Electrically conductive polymers used are preferably cationic polymers such as, for example, polyamines or polyethyleneimines.

According to a third embodiment, the aqueous composition of the invention comprises at least one kind of metal ions selected from the group consisting of the ions of molybdenum, copper, silver, gold, palladium, tin, and antimony, and at least one electrically conductive polymer selected from the group consisting of the polymer classes of the polyamines, polyanilines, polyimines, polythiophenes, and polypryrols.

Used preferably in the method of the invention are only treatment solutions and also aqueous compositions of the invention that contain less than 1.5 g/l, more preferably less than 1 g/l, more preferably less than 0.5 g/l, very preferably less than 0.1 g/l, and especially preferably less than 0.01 g/l of nickel ions.

Where a treatment solution or aqueous composition of the invention contains less than 0.01 g/l of nickel ions, it is to be deemed to be at least substantially nickel-free.

Contemplated in particular as conversion coatings which can be produced by means of, and/or treated with, the aqueous composition of the invention are phosphate coatings and also thin-film coatings. The thin-film coatings are, for instance, thin coatings of zirconium oxide and optionally at least one organosiloxane and/or of at least one organic polymer. Conversion coatings of this kind are applied by means of a corresponding phosphating solution or conversion/passivating solution.

Described below firstly, therefore, are phosphating solutions and also conversion/passivating solutions which comprise aqueous compositions of the invention. In this case, therefore, the aqueous compositions of the invention are themselves treatment solutions for producing a conversion coating, and the subsequently described phosphating solutions and also conversion/passivating solutions always also have the features described earlier on above for the aqueous composition of the invention.

Secondly, however, the description below of phosphating solutions and also conversion/passivating solutions is also valid for those treatment solutions which are not aqueous compositions of the invention. In this case, the aqueous compositions of the invention are employed instead as after-rinse solutions subsequent to treatment with such a phosphating solution or conversion/passivating solution, and so the subsequently described treatment solutions do not necessarily have the features described earlier on above for the aqueous composition of the invention.

i) Phosphating Solution

The phosphating solution may be an aqueous zinc phosphate solution or an aqueous alkali metal phosphate solution.

Where it is a zinc phosphate solution, it preferably comprises the following components in the following preferred and more preferred concentration ranges:

| | | |
|---|---|---|
| Zn | 0.3 to 3.0 g/l | 0.5 to 2.0 g/l |
| Mn | 0.3 to 2.0 g/l | 0.5 to 1.5 g/l |
| Phosphate (calculated as $P_2O_5$) | 8 to 25 g/l | 10 to 18 g/l |
| Free fluoride | 30 to 250 mg/l | 50 to 180 mg/l |
| Complex fluoride (calculated, e.g., as $SiF_6^{2-}$ and/or $BF_4^-$) | up to 5 g/l | 0.5 to 3 g/l |

With regard to the manganese ions, however, even a concentration in the range from 0.3 to 2.5 g/l, and, in terms of the free fluoride, a concentration in the range from 10 to 250 mg/l, have proven advantageous.

The complex fluoride is preferably tetrafluoroborate ($BF_4^-$) and/or hexafluorosilicate ($SiF_6^{2-}$).

According to one very preferred embodiment, the complex fluoride is a combination of tetrafluoroborate ($BF_4^-$) and hexafluorosilicate ($SiF_6^{2-}$), with the concentration of tetrafluoroborate ($BF_4^-$) being in the range up to 3 g/l, preferably from 0.2 to 2 g/l, and the concentration of hexafluorosilicate ($SiF_6^{2-}$) being in the range up to 3 g/l, preferably from 0.2 to 2 g/l.

According to another more preferred embodiment, the complex fluoride is hexafluorosilicate ($SiF_6^{2-}$) with a concentration in the range from 0.2 to 3 g/l, preferably from 0.5 to 2 g/l.

According to another more preferred embodiment, the complex fluoride is tetrafluoroborate ($BF_4^-$) with a concentration in the range from 0.2 to 3 g/l, preferably from 0.5 to 2 g/l.

Moreover, the phosphating solution preferably comprises at least one accelerator selected from the group consisting of the following compounds in the following preferred and more preferred concentration ranges:

| | | |
|---|---|---|
| Nitroguanidine | 0.2 to 3.0 g/l | 0.2 to 1.55 g/l |
| $H_2O_2$ | 10 to 100 mg/l | 15 to 50 mg/l |
| Nitroguanidine/ $H_2O_2$ | 0.2 to 2.0 g/l/10 to 50 mg/l | 0.2 to 1.5 g/l/15 to 30 mg/l |
| Nitrite | 30 to 300 mg/l | 90 to 150 mg/l |

With regard to the nitroguanidine, however, even a concentration in the range from 0.1 to 3.0 g/l, and, in terms of the $H_2O_2$, a concentration in the range from 5 to 200 mg/l, have proven advantageous.

The solution may additionally be characterized by the following preferred and more preferred parameter ranges:

| | | |
|---|---|---|
| FA | 0.3 to 2.0 | 0.7 to 1.6 |
| FA (dil.) | 0.5 to 8 | 1 to 6 |
| TAF | 12 to 28 | 22 to 26 |
| TA | 12 to 45 | 18 to 35 |
| A value | 0.01 to 0.2 | 0.03 to 0.15 |
| Temperature ° C. | 30 to 50° C. | 35 to 45° C. |

With regard to the FA parameter, however, even a value in the range from 0.2 to 2.5, and, in terms of the temperature, a value in the range from 30 to 55° C., have proven advantageous.

"FA" here stands for free acid, "FA (dil.)" stands for free acid (diluted), "TAF" stands for total acid, Fischer, "TA" stands for total acid, and "A value" stands for acid value.

These parameters are determined as follows:

Free Acid (FA):

For determination of the free acid, 10 ml of the phosphating solution are pipetted into a suitable vessel, such as a 300 ml Erlenmeyer flask. If the phosphating solution contains complex fluorides, an additional 2-3 g of calcium chloride are added to the sample. Subsequently, using a pH meter and an electrode, titration takes place with 0.1 M NaOH to a pH of 3.6. The quantity of 0.1 M NaOH consumed in the titration, in ml per 10 ml of the phosphating solution, gives the value of the free acid (FA) in points.

Free Acid (Diluted) (FA (Dil.)):

For determination of the free acid (diluted), 10 ml of the phosphating solution are pipetted into a suitable vessel, such as a 300 ml Erlenmeyer flask. Then 150 ml of DI water are added. Using a pH meter and an electrode, titration takes place with 0.1 M NaOH to a pH of 4.7. The quantity of 0.1 M NaOH consumed in the titration, in ml per 10 ml of the phosphating solution, gives the value of the free acid (diluted) (FA (dil.)) in points. From the difference relative to the free acid (FA) it is possible to ascertain the amount of complex fluoride. If this difference is multiplied by a factor of 0.36, the amount of complex fluoride is obtained as $SiF_6^{2-}$ in g/l.

Total Acid, Fischer (TAF):

Following the determination of the free acid (diluted), the dilute phosphating solution is admixed with potassium oxalate solution and then titrated with 0.1 M NaOH to a pH of 8.9, using a pH meter and an electrode. The consumption of 0.1 M NaOH in ml per 10 ml of the dilute phosphating solution in this procedure gives the total acid according to Fischer (TAF) in points. If this figure is multiplied by 0.71, the result is the total amount of phosphate ions reckoned as P205 (see W. Rausch: "Die Phosphatierung von Metallen". Eugen G. Leuze-Verlag 2005, 3rd edition, pp. 332 ff).

Total Acid (TA):

The total acid (TA) is the sum of the divalent cations present and also of free and bound phosphoric acids (the latter being phosphates). It is determined by the consumption of 0.1 M NaOH, using a pH meter and an electrode. For the determination, 10 ml of the phosphating solution are pipetted into a suitable vessel, such as a 300 ml Erlenmeyer flask, and diluted with 25 ml of DI water. Titration then takes place with 0.1 M NaOH to a pH of 9. The consumption in ml per 10 ml of the dilute phosphating solution corresponds here to the points number of the total acid (TA).

Acid Value (a Value):

The acid value (A value) stands for the ratio FA:TAF and is obtained by dividing the figure for the free acid (FA) by the figure for the total acid, Fischer (TAF).

ii) Conversion/Passivating Solution

The conversion/passivating solution is aqueous and comprises always 10 to 500 mg/l, preferably 30 to 300 mg/l, and more preferably 50 to 200 mg/l of Ti, Zr and/or Hf in complexed form (calculated as metal). The form in question preferably comprises fluoro complexes. Moreover, the conversion/passivating solution always comprises 10 to 500 mg/l, preferably 15 to 100 mg/l and more preferably 15 to 50 mg/l of free fluoride.

It preferably contains 10 to 500 mg/l, more preferably 30 to 300 mg/l and very preferably 50 to 200 mg/l of Zr in complexed form (calculated as metal).

It preferably further comprises at least one organosilane and/or at least one hydrolysis product thereof and/or at least one condensation product thereof in a concentration range from 5 to 200 mg/l, more preferably from 10 to 100 mg/l and very preferably from 20 to 80 mg/l (calculated as Si).

The at least one organosilane preferably has at least one amino group. More preferably it is an organosilane which can be hydrolyzed to aminopropylsilanol and/or to 2-aminoethyl-3-aminopropylsilanol, and/or is a bis(trimethoxysilylpropyl)amine.

The conversion/passivating solution may, moreover, comprise the following components in the following concentration ranges and preferred concentration ranges:

| | | |
|---|---|---|
| Zn | 0 to 5 g/l | 0.05 to 2 g/l |
| Mn | 0 to 1 g/l | 0.05 to 1 g/l |
| Nitrate | 0 to 10 g/l | 0.01 to 5 g/l |

iii) After-Rinse Solution

As stated, however, the aqueous composition of the invention may be not only a treatment solution for producing a conversion coating, but also an after-rinse solution for treating a metallic surface that has already been conversion-coated.

According to one embodiment, an after-rinse solution of this kind, in addition to water, comprises at least one kind of metal ions selected from the group consisting of the ions of the following metals in the following preferred, more preferred, and very preferred concentration ranges (all calculated as the metal in question):

| | | | |
|---|---|---|---|
| Mo | 1 to 1000 mg/l | 10 to 500 mg/l | 20 to 225 mg/l |
| Cu | 1 to 1000 mg/l | 3 to 500 mg/l | 5 to 225 mg/l |
| Ag | 1 to 500 mg/l | 5 to 300 mg/l | 20 to 150 mg/l |
| Au | 1 to 500 mg/l | 10 to 300 mg/l | 20 to 200 mg/l |
| Pd | 1 to 200 mg/l | 5 to 100 mg/l | 5 to 100 mg/l |
| Sn | 1 to 500 mg/l | 2 to 200 mg/l | 3 to 100 mg/l |
| Sb | 1 to 500 mg/l | 2 to 200 mg/l | 3 to 100 mg/l |

The metal ions are preferably molybdenum ions. They are added to the after-rinse solution preferably in the form of molybdate, more preferably of ammonium heptamolybdate, and very preferably of ammonium heptamolybdate×7 $H_2O$.

Molybdenum ions, however, may also be added, for example, in the form of at least one salt containing molybdenum cations, such as molybdenum chloride, to the after-rinse solution, and then oxidized to molybdate by a suitable oxidizing agent, as for example by the accelerators described later on below.

With further preference the after-rinse solution comprises molybdenum ions in combination with copper ions, tin ions or zirconium ions.

With particular preference it comprises molybdenum ions in combination with zirconium ions and also, optionally, a polymer or copolymer, selected more particularly from the group consisting of the polymer classes of the polyamines, polyanilines, polyimines, polythiophenes, and polypryroles, and also mixtures and copolymers thereof, and polyacrylic acid, with the amount of molybdenum ions and zirconium ions in each case being in the range from 10 to 500 mg/l (calculated as metal).

The amount of molybdenum ions here is preferably in the range from 20 to 225 mg/l, more preferably from 50 to 225 mg/l, and very preferably from 100 to 225 mg/l, and the amount of zirconium ions is preferably in the range from 30 to 300 mg/l, more preferably from 50 to 200 mg/l.

According to another preferred embodiment, the metal ions are copper ions. The after-rinse solution then preferably contains these ions in a concentration of 5 to 225 mg/l, more preferably of 150 to 225 mg/l.

According to a further embodiment, the after-rinse solution comprises at least one electrically conductive polymer selected from the group consisting of the polymer classes of the polyamines, polyanilines, polyimines, polythiophenes, and polypryrols. Preference is given to employing a polyamine and/or polyimine, more preferably a polyamine.

The polyamine is preferably a polyethyleneamine; the polyimine is preferably a polyethyleneimine.

The at least one electrically conductive polymer is present preferably in a concentration in the range from 0.1 to 5.0 g/l, more preferably from 0.2 to 3.0 g/l, and very preferably in the range from 0.5 to 1.5 g/l (calculated as pure polymer).

Electrically conductive polymers used are preferably cationic polymers such as, for example, polyamines or polyethyleneimines.

According to a third embodiment, the after-rinse solution comprises at least one kind of metal ions selected from the group consisting of the ions of molybdenum, copper, silver, gold, palladium, tin, and antimony, and at least one electrically conductive polymer selected from the group consisting of the polymer classes of the polyamines, polyanilines, polyimines, polythiophenes, and polypryrols.

The after-rinse solution preferably comprises additionally 10 to 500 mg/l, more preferably 30 to 300 mg/l and very preferably 50 to 200 mg/l of Ti, Zr and/or Hf in complexed form (calculated as metal). The form in question preferably comprises fluoro complexes. Moreover, the after-rinse solution preferably comprises 10 to 500 mg/l, more preferably 15 to 100 mg/l and very preferably 15 to 50 mg/l of free fluoride.

The after-rinse solution more preferably comprises Zr in complexed form (calculated as metal) and at least one kind of metal ions selected from the group consisting of the ions of molybdenum, copper, silver, gold, palladium, tin and antimony, preferably of molybdenum.

An after-rinse solution comprising Ti, Zr and/or Hf in complexed form preferably further comprises at least one organosilane and/or at least one hydrolysis product thereof and/or at least one condensation product thereof in a concentration range from 5 to 200 mg/l, more preferably from 10 to 100 mg/l, and very preferably from 20 to 80 mg/l (calculated as Si).

The at least one organosilane preferably has at least one amino group. More preferably it is an organosilane which can be hydrolyzed to aminopropylsilanol and/or to 2-aminoethyl-3-aminopropylsilanol, and/or is a bis(trimethoxysilylpropyl)amine.

The pH of the after-rinse solution is preferably in the acidic range, more preferably in the range from 3 to 5, very preferably in the range from 3.5 to 5.

According to one preferred embodiment of the method of the invention, a metallic surface is first treated with an at least very largely nickel-free zinc phosphate solution so as to form an at least very largely nickel-free phosphate coating on the metallic surface.

After optional drying, the metallic surface thus coated is treated with an after-rinse solution of the invention, to give an at least very largely nickel-free phosphate coating having a defined electrical conductivity.

Subsequently—again after optional drying—an electrocoat material is deposited cathodically on the metallic surface thus coated.

According to a further preferred embodiment of the method of the invention, a metallic surface is first treated with a conversion/passivating solution which comprises 10 to 500 mg/l of Zr in complexed form (calculated as metal) and optionally also comprises at least one organosilane and/or at least one hydrolysis products thereof and/or at least one condensation products thereof in a concentration range from 5 to 200 mg/l (calculated as Si), to form a corresponding thin-film coating on the metallic surface.

After optional drying, the metallic surface thus coated is treated with an after-rinse solution of the invention and in this way a thin-film coating having a defined electrical conductivity is obtained.

Subsequently—again after optional drying—an electrocoat material is deposited cathodically on the metallic surface thus coated.

According to a third preferred embodiment of the method of the invention, a metallic surface is first treated with a conversion/passivating solution of the invention which comprises 10 to 500 mg/l of Zr in complexed form (calculated as metal) and optionally also comprises at least one organosilane and/or at least one hydrolysis products thereof and/or at least one condensation products thereof in a concentration range from 5 to 200 mg/l (calculated as Si), to form a corresponding thin-film coating having a defined electrical conductivity on the metallic surface.

After optional drying, an electrocoat material is deposited cathodically on the metallic surface thus coated.

The method of the invention allows the electrical conductivity of a conversion coating to be adjusted in a specific way. The conductivity here may alternatively be greater than, equal to or less than that of a corresponding nickel-containing conversion coating.

The electrical conductivity of a conversion coating, adjusted by the method of the invention, can be influenced by varying the concentration of any given metal ion and/or electrically conductive polymer.

The present invention further relates to a concentrate which is obtained by diluting an aqueous composition of the invention with water by a factor of between 1 and 100, preferably between 5 and 50, and, where necessary, adding a pH-modifying substance.

Lastly, the present invention further relates to a conversion-coated metallic surface which is obtainable by the method of the invention.

The purpose of the text below is to illustrate the present invention by means of working examples, which should not be considered to impose any restriction, and comparative examples.

Comparative Example 1

A test plate made of electrolytically galvanized steel (ZE) was coated using a phosphating solution containing 1 g/l of nickel. No after-rinsing was performed. The current density i was then measured in $A/cm^2$ over the voltage E in V applied against a silver/silver chloride (Ag/AgCl) electrode (see FIG. 1: ZE_Variation11_2: curve 3). The measurement took place by means of linear sweep voltammetry (potential range: −1.1 to −0.2 Vref; scan rate: 1 mV/s).

In all of the examples and comparative examples, the measured current density i is dependent on the electrical conductivity of the conversion coating. The relationship is as follows: the higher the measured current density i, the higher the electrical conductivity of the conversion coating as well. With conversion coatings, it is not possible to carry out direct measurement of the electrical conductivity in μS/cm, of the kind which is possible in liquid media.

In the present case, therefore, the current density i measured for a nickel-containing conversion coating serves always as a reference point for statements made about the electrical conductivity of a given conversion coating.

The indication "1E" in FIGS. 1 to 4 always stands for "10". Accordingly, for example, "1E-4" means "10-4".

Comparative Example 2

A test plate as per comparative example 1 was coated using a nickel-free phosphating solution, without after-rinsing, and then the current density i was measured over the voltage E as per comparative example 1 (see FIG. 1. ZE_Variation1_1: curve 1; ZE_Variation1_3: curve 2).

As can be seen from FIG. 1, the rest potential of the nickel-free system (comparative example 2) relative to that of the nickel-containing system (comparative example 1) has shifted to the left. The electrical conductivity is lower as well: The "arms" of curve 1 and also of curve 2 are in each case located below curve 3, i.e., toward lower current densities.

Comparative Example 3

A test plate as per comparative example 1 was coated using a nickel-free phosphating solution. The test plate thus coated was subsequently treated with an after-rinse solution containing about 120 mg/l of $ZrF_6^{2-}$ (calculated as Zr), with a pH of about 4. The current density i over the voltage E was measured as per comparative example 1 (see FIG. 2. ZE_Variation6_1: curve 1; ZE_Variation6_2: curve 2). Comparison is made with comparative example 1 (FIG. 2: ZE_Variation11_2: curve 3).

Figure 2:
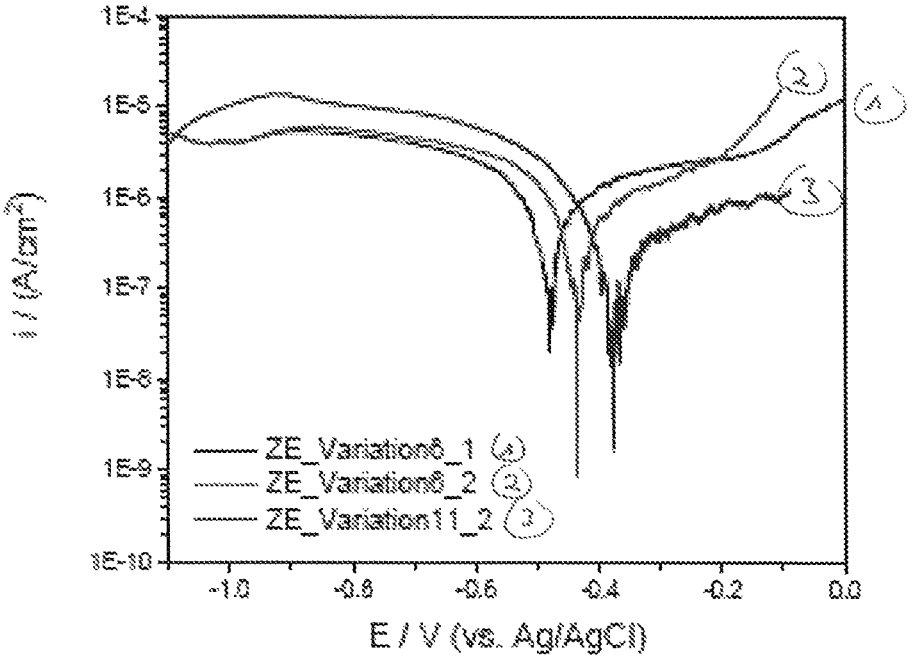
FIG. 2 depicts the current density over the voltage applied against a silver/silver chloride (Ag/AgCl) electrode for a test plate according to Comparative Example 3 of the present disclosure.

As can be seen from FIG. 2, the rest potential of the nickel-free system when using a $ZrF_6^{2-}$-containing after-rinse solution (comparative example 3) has shifted to the left relative to that of the nickel-containing system (comparative example 1). The electrical conductivity is also lower for the stated nickel-free system (cf. the observations made in relation to comparative example 2).

Example 1

A test plate as per comparative example 1 was coated using a nickel-free phosphating solution. The test plate thus coated was subsequently treated with an after-rinse solution containing about 220 mg/l of copper ions, with a pH of about 4. The current density i over the voltage E was measured as per comparative example 1 (see FIG. 3. ZE_Variation2_1: curve 1; ZE_Variation2_2: curve 2). Comparison is made with comparative example 1 (FIG. 3: ZE_Variation11_2: curve 3).

Figure 3:
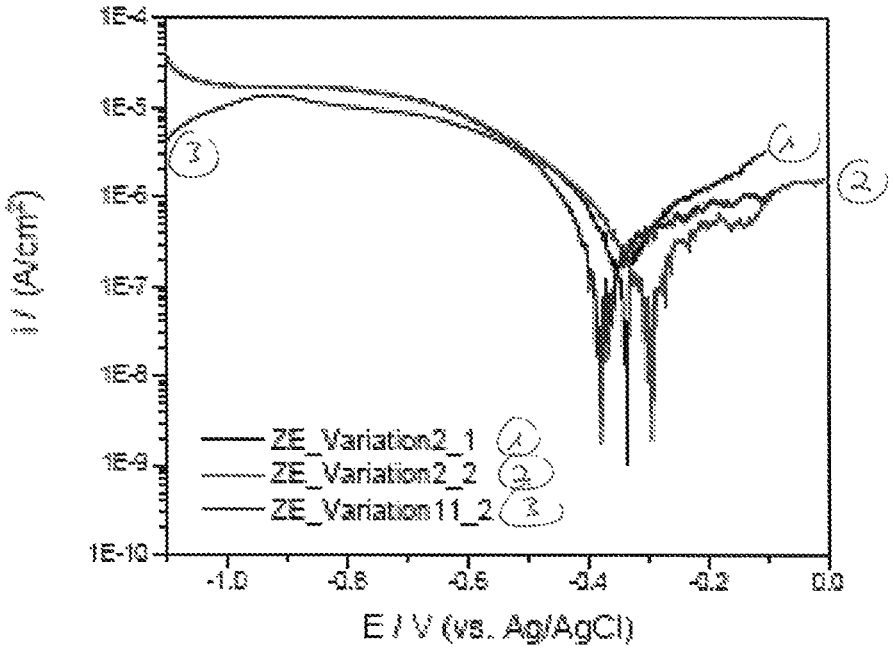
FIG. 3 depicts the current density over the voltage applied against a silver/silver chloride (Ag/AgCl) electrode for a test plate according to Example 1 of the present disclosure.

As can be seen from FIG. 3, the rest potential of the nickel-free system when using a copper-ion-containing after-rinse solution (example 1) corresponds to that of the nickel-containing system (comparative example 1). The conductivity of this nickel-free system is increased slightly relative to that of the nickel-containing system.

Example 2

A test plate as per comparative example 1 was coated using a nickel-free phosphating solution. The test plate thus coated was subsequently treated with an after-rinse solution which contained about 1 g/l (calculated on the basis of the pure polymer) on electrically conductive polyamine (Lupamin® 9030, manufacturer BASF) and had a pH of about 4. The current density i over the voltage E was measured as per comparative example 1 (see FIG. 4. ZE_Variation3_1: curve 1; ZE_Variation3_2: curve 2). Comparison is made with comparative example 1 (FIG. 4: ZE_Variation11_2: curve 3).

Figure 4:
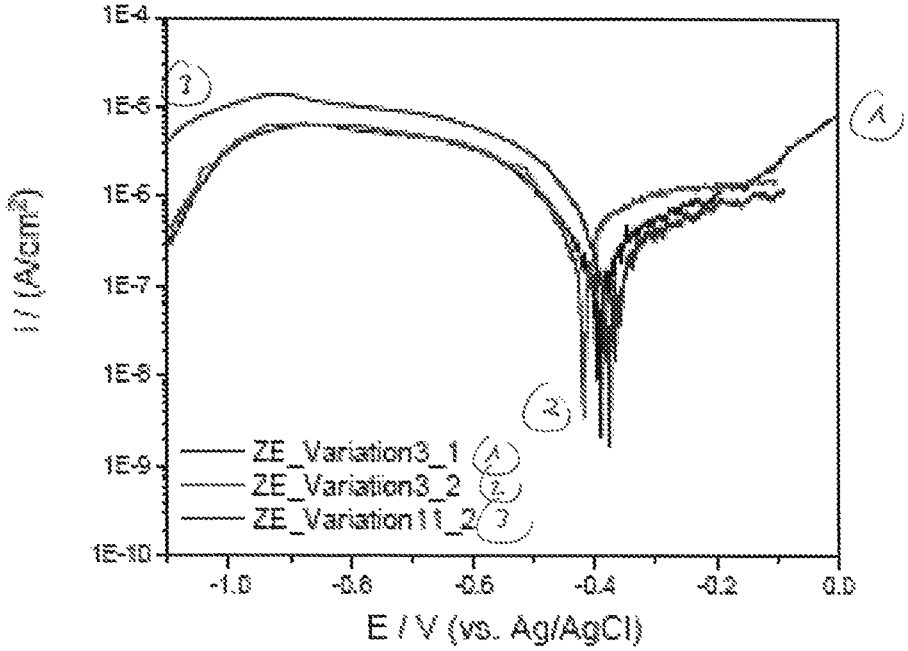
FIG. 4 depicts the current density over the voltage applied against a silver/silver chloride (Ag/AgCl) electrode for a test plate according to Example 2 of the present disclosure.

As can be seen from FIG. 4, the rest potential of the nickel-free system when using a after-rinse solution containing an electrically conductive polymer (example 2) corresponds to that of the nickel-containing system (comparative example 1). The electrical conductivity of the nickel-free system is reduced somewhat here relative to that of its nickel-containing counterpart.

Comparative Example 3

A test plate made of hot-dip-galvanized steel (EA) was coated using a phosphating solution containing 1 g/l of nickel. The test plate thus coated was subsequently treated with an after-rinse solution containing about 120 mg/l of $ZrF_6^{2-}$ (calculated as Zr) with a pH of about 4, after which the current density i in $A/cm^2$ was measured over the voltage E in V applied against a silver/silver chloride (Ag/AgCl) electrode (see FIG. 5: EA 173: curve 1). The measurement was made using linear sweep voltammetry.

Comparative Example 4

Figure 5:
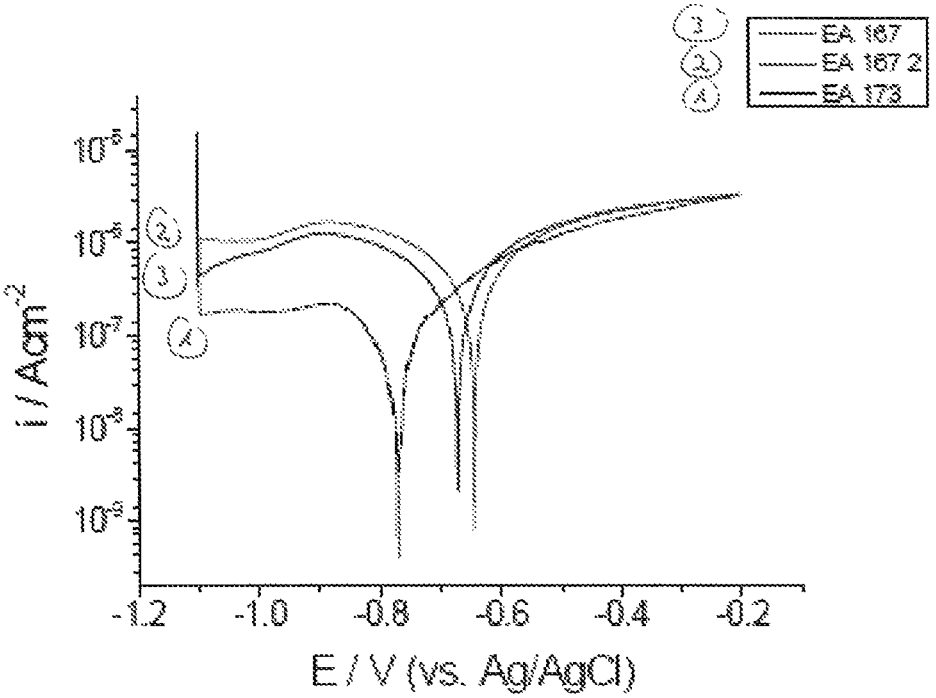
FIG. 5 depicts the current density over the voltage applied against a silver/silver chloride (Ag/AgCl) electrode for test plates according to Comparative Example 3 and Comparative Example 4 of the present disclosure.

A test plate as per comparative example 3 was coated using a nickel-free phosphating solution without after-rinsing, and then the current density i over the voltage E was measured as per comparative example 3 (see FIG. 5. EA 167: curve 3; EA 167 2: curve 2).

As can be seen from FIG. 5, the rest potential of the nickel-free system (comparative example 4) has shifted to the right relative to that of the nickel-containing system (comparative example 3). The electrical conductivity in the case of the nickel-containing system is much lower, owing to the passivation with the $ZrF_6^{2-}$-containing after-rinse solution.

Example 3

A test plate as per comparative example 3 was coated using a nickel-free phosphating solution. The test plate thus coated was subsequently treated with an after-rinse solution containing about 120 mg/l of $ZrF_6^{2-}$ (calculated as Zr) and 220 mg/l of molybdenum ions, with a pH of about 4. The current density i over the voltage E was measured as per comparative example 1 (see FIG. 6. EA 178: curve 3; EA 178 2: curve 2). Comparison is made with comparative example 3 (FIG. 6: EA 173: curve 1).

Figure 6:
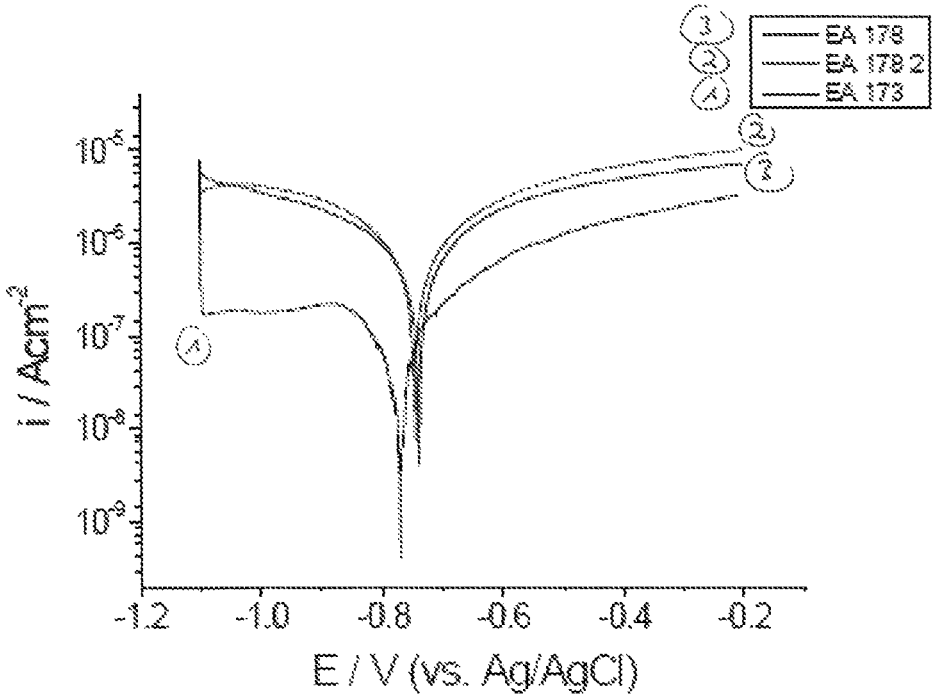
FIG. 6 depicts the current density over the voltage applied against a silver/silver chloride (Ag/AgCl) electrode for a test plate according to Example 3 of the present disclosure.

As can be seen from FIG. 6, the rest potential of the nickel-free system when using an after-rinse solution containing $ZrF_6^{2-}$ and molybdenum ions (example 3) corresponds to that of the nickel-containing system (comparative example 3). By adding molybdenum ions (example 3) to the $ZrF_6^{2-}$-containing after-rinse solution (comparative example 3) it was possible to increase significantly the conductivity on the substrate surface.

Comparative Example 5

Hot-dip-galvanized (HDG) or electrolytically galvanized (EG) steel test plates were sprayed at 60° C. for 180 s with an aqueous cleaning solution which contained a surfactant and had a pH of 10.8. The cleaning solution was subsequently rinsed off from the test plates by spraying them with mains water for 30 s first and then with deionized water for 20 s. The cleaned test plates were thereafter immersed for 175 s into a conversion/passivating solution which contained 40 mg/l of Si, 140 mg/l of Zr, 2 mg/l of Cu, and 30 mg/l of free fluoride and had a pH of 4.8 and a temperature of 30° C. The aqueous conversion/passivating solution was subsequently rinsed off from the test plates by immersing them in deionized water for 50 s and subsequently spraying them with deionized water for 30 s. The test plates thus pretreated were then cathodically dip-coated either with a first specific CEC material (CEC 1) or with a second specific CEC material (CEC 2).

Example 4

Hot-dip-galvanized (HDG) or electrolytically galvanized (EG) steel test plates were treated as per comparative example 5, with the difference that the aqueous conversion/passivating solution was subsequently rinsed off from the test plates by immersing them for 50 s into an aqueous solution containing 100 mg/l of Mo (calculated as metal), which was added in the form of ammonium heptamolybdate, (after-rinse solution) and subsequently spraying them with deionized water for 30 s.

Example 5

Hot-dip-galvanized (HDG) or electrolytically galvanized (EG) steel test plates were treated as per comparative example 5, with the difference that the aqueous conversion/passivating solution was subsequently rinsed off from the test plates by immersing them for 50 s into an aqueous solution containing 200 mg/l of Mo (calculated as metal), which was added in the form of ammonium heptamolybdate, (after-rinse solution) and subsequently spraying them with deionized water for 30 s.

Example 6

Hot-dip-galvanized (HDG) or electrolytically galvanized (EG) steel test plates were treated as per comparative example 5, with the difference that the aqueous conversion/passivating solution additionally contained 100 mg/l of Mo (calculated as metal), which was added in the form of ammonium heptamolybdate.

The test plates as per comparative example 5 (CE5) and examples 4 to 6 (E4 to E6) were subsequently subjected to a paint adhesion test from the automobile manufacturer PSA (heat-humidity test).

The cross-cut and coating loss results obtained can be seen in tab. 1. In the case of the cross-cut results, 1 stands for the best and 6 for the worst score. For the coating loss results, 100% denotes complete loss of coating.

The test plates as per comparative example 5 (CE5) and examples 4 to 6 (E4 to E6) were also investigated by the method known as that of cathodic polarization.

This method describes an accelerated electrochemical test which is performed on coated steel panels having being subjected to defined damage. According to the principle of an electrostatic holding test, testing takes place to determine how effectively the coating on the metal test plate withstands the process of corrosive undermining.

The scratched test plate (scratching tool for 0.5 mm scratch width, e.g. Clemen testing tip (R=1 mm); stencil for scratching) is installed in the measuring cell (galvanostat as current source (20 mA in the regulating range); thermostat with connections for temperature regulation 40° C.+/−0.5° C.; glass electrolysis cell with heating jacket, complete with reference electrode; counter electrode, gasket and ovals). It must be ensured here that the two electrode rods lie parallel to the scratch.

After the lid has been locked in, the cell is filled with about 400 mL of 0.1 M Na sulfate solution. The clips are then connected as follows: green-blue clip to working electrode (metal plate), orange-red clip to counter electrode (electrode with parallel rods), white clip to reference electrode (in Haber-Luggin capillary).

The cathodic polarization is then started via the control software (control instrument with software) and a current of 20 mA is set on the test plate over a period of 24 hours. During this time, the measuring cell is conditioned at 40° C.+/−0.5 degree using the thermostat. In the 24-hour exposure time, hydrogen is evolved at the cathode (test plate) and oxygen at the counter electrode.

Following measurement, the metal plate is immediately uninstalled, in order to avoid secondary corrosion, and is rinsed off with DI water and dried in the air. Using a blunt knife, the coating film detached is removed. Other detached regions of coating can be removed using a strong textile adhesive tape (e.g., Tesaband 4657 gray). Thereafter the exposed area is evaluated (ruler, magnifying glass if needed).

For this purpose, the width of the detached area is determined with an accuracy of 0.5 mm, with a spacing of 5 mm in each case. The averaged delamination width is calculated according to the following equations:

$$d_1=(a_1+a_2+a_3+\ldots)/n \quad \text{Equation 1:}$$

$$d=(d_1-w)/2 \quad \text{Equation 2:}$$

$d_1$: average delamination width in mm $a_1$, $a_2$, $a_3$: individual delamination widths in mm n: number of individual widths w: width of scratch mark in mm d: average width of delamination, width of undermining in mm The result is reported in mm and is rounded to one decimal place. The standard deviation of the measurements is below 20%. The delamination values obtained in this way are likewise shown in tab. 1.

Test plates as per comparative examples 1 to 3 (CE1 to CE3) and also examples 1 and 2 (E1 and E2) were CEC-coated and then subjected to a DIN EN ISO 2409 cross-cut test. Testing took place in each case on 3 plates before and after exposure for 240 hours to condensation water (DIN EN ISO 6270-2 CH). The corresponding results are found in tab. 2. A cross-cut result of 0 here is the best, a result of 5 the worst score.

TABLE 1

| (Comp.) ex. | Test plate | CEC coating | Cross-cut (1-6) | Coating loss (%) | Delamination (mm) |
|---|---|---|---|---|---|
| CE5 | HDG | CEC 1 | 6 | 50 | 11.9 |
| | | | 6 | 50 | |
| | | CEC 2 | 2 | 0 | 8.9 |
| | | | 2 | 0 | |
| | EG | CEC 1 | 6 | 50 | 8.5 |
| | | | 6 | 50 | |
| | | CEC 2 | 2 | 0 | 6.3 |
| | | | 2 | 0 | |
| E4 | HDG | CEC 1 | 3 | 1 | 2.9 |
| | | | 2 | 1 | |
| | | CEC 2 | 2 | 0 | 2.8 |
| | | | 2 | 0 | |
| | EG | CEC 1 | 2 | 1 | 1.9 |
| | | | 4 | 1 | |
| | | CEC 2 | 2 | 0 | 2.4 |
| | | | 1 | 0 | |
| E5 | HDG | CEC 1 | 5 | 1 | 3.3 |
| | | | 5 | 1 | |
| | | CEC 2 | 3 | 0 | 2.6 |
| | | | 2 | 0 | |
| | EG | CEC 1 | 2 | 1 | 2.1 |
| | | | 2 | 1 | |
| | | CEC 2 | 2 | 0 | 1.7 |
| | | | 2 | 0 | |
| E6 | HDG | CEC 1 | 2 | 1 | 2.8 |
| | | | 2 | 0 | |
| | | CEC 2 | 2 | 0 | 2.2 |
| | | | 2 | 0 | |
| | EG | CEC 1 | 1 | 1 | 1.4 |
| | | | 2 | 0 | |
| | | CEC 2 | 2 | 0 | 1.6 |
| | | | 1 | 0 | |

TABLE 2

| (Comparative) Example | Cross-cut (0-5) before exposure | Cross-cut (0-5) after exposure |
|---|---|---|
| CE1 | 0/0/0 | 1/1/0 |
| CE2 | 1/0/0 | 3/1/0 |
| CE3 | 0/0/1 | 1/5/4 |
| E1 | 1/0/0 | 0/0/1 |
| E2 | 1/1/1 | 1/1/1 |

As can be seen from tab. 1, the use of Mo, both in the conversion/passivating solution and in the after-rinse solution, especially in conjunction with the CEC 1 coating, leads to the advantage of improved coating adhesion (lower cross-cut and coating loss scores for E4 to E6 in comparison to CE5). Tab. 1 further reveals that Mo, both in the conversion/passivating solution and in the after-rinse solution, leads to significantly reduced delamination (E4 to E6 in comparison to CE5).

This positive effect is attributable to the fact that the use of Mo leads to increased conductivity of the surface and therefore very largely prevents attack on the conversion coat during the current-flow-dependent cathodic electrocoating.

Tab. 2 reveals the poor results of CE2 and especially CE3 in each case after exposure, whereas E1 (copper ions) and E2 (electroconductive polyamine) yield results which are good and are comparable to CE1 (nickel-containing phosphating).

Example 7

A test plate as per comparative example 1 was coated using a nickel-free phosphating solution. The test plate thus coated was subsequently treated with an after-rinse solution which contained about 1 g/l (calculated on the basis of the pure polymer) of electrically conductive polyimine having a number-average molecular weight of 5000 g/mol (Lupasol® G 100, manufacturer BASF) and had a pH of about 4.

Example 8

A test plate as per comparative example 1 was coated using a nickel-free phosphating solution. The test plate thus coated was subsequently treated with an after-rinse solution containing 130 mg/l of $ZrF_6^{2-}$ (calculated as Zr) and 20 mg/l of molybdenum ions and, additionally, 1.2 g/l (calculated on the basis of the pure polymer) of polyacrylic acid having a number-average molecular weight of 60 000 g/mol and had a pH of about 4.

Comparative Example 6

Corresponds to comparative example 1, with the difference that a test plate made of hot-dip-galvanized steel (EA) is used.

Comparative Example 7

Corresponds to comparative example 2, with the difference that a test plate made of hot-dip-galvanized steel (EA) is used.

Example 9

A test plate made of hot-dip-galvanized steel (EA) was coated using a nickel-free phosphating solution. The test plate thus coated was subsequently treated with an after-rinse solution which contained about 1 g/l (calculated on the basis of the pure polymer) of electrically conductive polyimine having a number-average molecular weight of 5000 g/mol (Lupasol® G 100, manufacturer BASF) and had a pH of about 4.

Example 10

A test plate made of hot-dip-galvanized steel (EA) was coated using a nickel-free phosphating solution. The test plate thus coated was subsequently treated with an after-rinse solution containing 130 mg/l of $ZrF_6^{2-}$ (calculated as Zr) and 20 mg/l of molybdenum ions and, additionally, 1.2 g/l (calculated on the basis of the pure polymer) of polyacrylic acid having a number-average molecular weight of 60 000 g/mol and had a pH of about 4.

Comparative Example 8

Corresponds to comparative example 1, with the difference that a test plate made of steel is used.

Comparative Example 9

Corresponds to comparative example 2, with the difference that a test plate made of steel is used.

Example 11

A test plate made of steel was coated using a nickel-free phosphating solution. The test plate thus coated was subsequently treated with an after-rinse solution containing 230 mg/l of copper ions, with a pH of about 4.

Comparative Example 10

Corresponds to comparative example 1, with the difference that the phosphating solution contains 1 g/l of $BF_4^-$ and 0.2 g/l of $SiF_6^{2-}$ and, after the phosphating, treatment takes place with an with an after-rinse solution containing about 120 mg/l of $ZrF_6^{2-}$ (calculated as Zr), with a pH of about 4.

Comparative Example 11

Corresponds to comparative example 2, with the difference that the phosphating solution contains 1 g/l of $BF_4^-$ and 0.2 g/l of $SiF_6^{2-}$.

Example 12

A test plate made of electrolytically galvanized steel (ZE) was coated using a nickel-free phosphating solution which contained 1 g/l of $BF_4^-$ and 0.2 g/l of $SiF_6^{2-}$. The test plate thus coated was subsequently treated with an after-rinse solution containing 160 mg/l of $ZrF_6^{2-}$ (calculated as Zr) and 240 mg/l of molybdenum ions, with a pH of about 4.

Comparative Example 12

Corresponds to comparative example 1, with the difference that a test plate made of hot-dip-galvanized steel (EA) is used, the phosphating solution contains 1 g/l of $BF_4^-$ and 0.2 g/l of $SiF_6^{2-}$, and, after the phosphating, treatment takes place with an with an after-rinse solution containing about 120 mg/l of $ZrF_6^{2-}$ (calculated as Zr), with a pH of about 4.

Comparative Example 13

Corresponds to comparative example 2, with the difference that a test plate made of hot-dip-galvanized steel (EA) is used and the phosphating solution contains 1 g/l of $BF_4^-$ and 0.2 g/l of $SiF_6^{2-}$.

Example 13

A test plate hot-dip-galvanized steel (EA) was coated using a nickel-free phosphating solution which contained 1 g/l of $BF_4^-$ and 0.2 g/l of $SiF_6^{2-}$. The test plate thus coated was subsequently treated with an after-rinse solution containing 160 mg/l of $ZrF_6^{2-}$ (calculated as Zr) and 240 mg/l of molybdenum ions, with a pH of about 4.

Comparative Example 14

Corresponds to comparative example 1, with the difference that the phosphating solution contains 1 g/l of $SiF_6^{2-}$ and, after the phosphating, treatment takes place with an with an after-rinse solution containing about 120 mg/l of $ZrF_6^{2-}$ (calculated as Zr), with a pH of about 4.

Comparative Example 15

Corresponds to comparative example 2, with the difference that the phosphating solution contains 1 g/l of $SiF_6^{2-}$.

Example 14

A test plate made of electrolytically galvanized steel (ZE) was coated using a nickel-free phosphating solution which contained 1 g/l of $SiF_6^{2-}$. The test plate thus coated was subsequently treated with an after-rinse solution containing 160 mg/l of $ZrF_6^{2-}$ (calculated as Zr) and 240 mg/l of molybdenum ions, with a pH of about 4.

Comparative Example 16

Corresponds to comparative example 1, with the difference that a test plate made of hot-dip-galvanized steel (EA) is used, the phosphating solution contains 1 g/l of $SiF_6^{2-}$, and, after the phosphating, treatment takes place with an with an after-rinse solution containing about 120 mg/l of $ZrF_6^{2-}$ (calculated as Zr), with a pH of about 4.

Comparative Example 17

Corresponds to comparative example 2, with the difference that a test plate made of hot-dip-galvanized steel (EA) is used and the phosphating solution contains 1 g/l of $SiF_6^{2-}$.

Example 15

A test plate made of hot-dip-galvanized steel (EA) was coated using a nickel-free phosphating solution which contained 1 g/l of $SiF_6^{2-}$. The test plate thus coated was subsequently treated with an after-rinse solution containing 160 mg/l of $ZrF_6^{2-}$ (calculated as Zr) and 240 mg/l of molybdenum ions, with a pH of about 4.

Test plates as per comparative examples 1, 2, 6 and 7 (CE1, CE2, CE6, and CE7) and also examples 7 to 10 (E7 to E10) were CEC-coated. This was done using four programs which differed in terms of (a) the ramp time, in other words the time to attainment of maximum voltage, (b) the maximum voltage and/or (c) the time of exposure to maximum voltage:

| | | | |
|---|---|---|---|
| Program 1: | (a) 30 sec | (b) 240 V | (c) 150 sec |
| Program 2: | (a) 30 sec | (b) 220 V | (c) 150 sec |
| Program 3: | (a) 3 sec | (b) 240 V | (c) 150 sec |
| Program 4: | (a) 3 sec | (b) 220 V | (c) 150 sec |

The film thickness of the deposited CEC coating, measured in each case by means of a Fischer DUALSCOPE®, can be seen in tab. 3.

Test plates as per comparative examples 8 to 17 (CE8 to CE17) and also examples 11 to 15 (E11 to E15) were subjected to analysis by X-ray fluorescence (XFA). Tab. 4 shows the amounts of copper and, respectively, zirconium and molybdenum (calculated as metal in each case) determined in each case in the surface. The stated test plates were subsequently CEC-coated. This was done using the following programs, which according to (comparative) example differed in terms of (a) the ramp time, in other words the time to attainment of maximum voltage, (b) the maximum voltage and/or (c) the time of exposure to maximum voltage:

| | | | |
|---|---|---|---|
| CE8, CE9, E11: | (a) 30 sec | (b) 250 V | (c) 240 sec |
| CE10, CE11, CE14, CE15, E12, E14: | (a) 30 sec | (b) 260 V | (c) 300 sec |
| CE12; CE13, CE16; CE17, E13, E15: | (a) 30 sec | (b) 260 V | (c) 280 sec |

The film thickness of the deposited CEC coating, measured in each case by means of a Fischer DUALSCOPE®, can be seen in tab. 4.

TABLE 3

| (Comparative) example | Program 1: Film thickness (μm) | Program 2: Film thickness (μm) | Program 3: Film thickness (μm) | Program 4: Film thickness (μm) |
|---|---|---|---|---|
| CE1 | 19.4 | 17.7 | 21.4 | 18.4 |
| CE2 | 16 | 15 | 17.4 | 15.9 |
| E7 | 20.4 | 17.8 | 22.6 | 19.1 |
| E8 | 19 | 17.4 | 19.8 | 18 |
| CE6 | 21.5 | 19.5 | 21.2 | 19.2 |
| CE7 | 19.1 | 17 | 18.6 | 17.1 |
| E9 | 22.8 | 20 | 23.5 | 20.5 |
| E10 | 20.3 | 18.7 | 21.6 | 18.8 |

TABLE 4

| (Comparative) example | Cu content ($mg/m^2$) | Mo content ($mg/m^2$) | Zr content ($mg/m^2$) | CEC thickness (μm) |
|---|---|---|---|---|
| CE8 | 0 | — | — | 19.5 |
| CE9 | 0 | — | — | 19.9 |

TABLE 4-continued

| (Comparative) example | Cu content ($mg/m^2$) | Mo content ($mg/m^2$) | Zr content ($mg/m^2$) | CEC thickness (μm) |
|---|---|---|---|---|
| E11 | 20 | — | — | 22.9 |
| CE10 | — | 0 | 5 | 19.7 |
| CE11 | — | 0 | 0 | 18 |
| E12 | — | 8 | 6 | 19.6 |
| CE12 | — | 0 | 7 | 21.6 |
| CE13 | — | 0 | 0 | 20 |
| E13 | — | 5 | 6 | 21.7 |
| CE14 | — | 0 | 5 | 19.7 |
| CE15 | — | 0 | 0 | 18 |
| E14 | — | 9 | 8 | 19.1 |
| CE16 | — | 0 | 6 | 22.1 |
| CE17 | — | 0 | 0 | 20 |
| E15 | — | 10 | 10 | 21.7 |

Tab. 3 shows in each case a significant decrease in the film thickness of the CEC coating in the case of nickel-free as compared to nickel-containing phosphating (CE2 vs. CE1; CE7 vs. CE6). By using the after-rinse solutions of the invention, however, the film thickness obtained in the case of nickel-free phosphating can be increased again (E7 and E8 vs. CE2; E9 and E10 vs. CE6)—in the case of E7 and E9, it can be increased, indeed, beyond the level of the nickel-containing phosphating.

From tab. 4 it is evident that the use of a copper-containing after-rinse solution of the invention (in the case of previous nickel-free phosphating) leads to incorporation of copper into the test plate surface. As a consequence the CEC deposition is improved, even relative to the nickel-containing system (E11 vs. CE8). The copper content of the surface increases its conductivity. This results in more effective CEC deposition, a phenomenon manifested, under otherwise identical conditions, in the higher film thickness of the CEC coating. Through the use of zirconium-containing and molybdenum-containing after-rinse solutions of the invention (after nickel-free phosphating), accordingly, molybdenum is incorporated into the surface of the test plates, a feature which brings the CEC deposition back again (almost) to the level of the nickel-containing phosphating (E12 vs. CE10; E13 vs CE12; E14 vs. CE14; E15 vs. CE16).

The invention claimed is:

1. A method for specifically adjusting the electrical conductivity of a conversion coating, wherein a metallic surface is first treated with a conversion/passivating solution which comprises 10 to 500 mg/l of Zr in complexed form, calculated as metal, and comprises at least one organosilane and/or at least one hydrolysis product thereof and/or at least one condensation product thereof in a concentration range of 5 to 200 mg/l, calculated as Si, so as to form a corresponding thin-film coating on the metallic surface, and wherein the metallic surface thus coated is treated with an aqueous composition as an after-rinse solution which comprises 20 to 225 mg/l of molybdenum and copper ions.

2. The method according to claim 1, wherein the organosilane can be hydrolyzed to at least one of an aminopropylsilanol, 2-aminoethyl-3-aminopropylsilanol, and bis (trimethoxysilylpropyl)amine.

3. The method according to claim 1, wherein the aqueous composition further comprises zirconium ions.

4. The method according to claim 3, wherein the aqueous composition further comprises 50 and 200 mg/l of the zirconium ions.

5. The method according to claim 1, wherein the aqueous composition further comprises at least one of a polyamine and polyimine.

6. The method according to claim 1, wherein the aqueous composition has a pH between 3.5 and 5.

7. The method according to claim 1, wherein the aqueous composition comprises between 150 and 225 mg/l of the copper ions.

8. The method according to claim 1, further comprising drying the coated metallic surface before treating the coated metallic surface with the aqueous composition.

* * * * *